United States Patent [19]

Fletcher

[11] Patent Number: 5,005,454

[45] Date of Patent: Apr. 9, 1991

[54] LAMINA CLIPPING DEVICE AND METHOD

[75] Inventor: M. Ray Fletcher, Lexington, N.C.

[73] Assignee: Fletcher Machine, Inc., Lexington, N.C.

[21] Appl. No.: 396,096

[22] Filed: Aug. 21, 1989

[51] Int. Cl.[5] ..... B26D 5/12

[52] U.S. Cl. ..... 83/13; 83/613; 83/639.1; 83/694; 83/697; 83/914; 30/229

[58] Field of Search ..... 83/13, 613, 639.1, 636, 83/694, 697, 914, 929, 465; 156/267; 30/229

[56] References Cited

U.S. PATENT DOCUMENTS

| | | | |
|---|---|---|---|
| 596,546 | 1/1898 | Runyan | 30/229 X |
| 2,391,598 | 12/1945 | Serdich | 30/229 |
| 2,951,289 | 9/1960 | Ferbrache et al. | 30/229 X |
| 3,803,968 | 4/1974 | Black | 83/636 X |
| 4,092,891 | 6/1978 | Hansen et al. | 83/694 X |
| 4,220,063 | 9/1980 | Klemer et al. | 83/639.1 X |
| 4,604,929 | 8/1986 | Vallance | 83/636 X |

OTHER PUBLICATIONS

Single and Double Edge Systems by Fletcher brochure.
Fletcher Machine-FT-200-D Edge Machine brochure.
Fletcher Machine: Pride and Performance brochure.

*Primary Examiner*—Mark Rosenbaum
*Assistant Examiner*—Eugenia A. Jones

[57] ABSTRACT

A lamina clipping device and method are presented whereby edge excess lamina portions of a laminated substrate can be trimmed at the corners in an efficient and clean, finished fashion. One blade is stationarily mounted to a base and a second movable blade is joined thereto whereby a substrate can be positioned against the stationary blade and the movable blade actuated to clip the excess lamina along the edge thereof as the blades come together.

17 Claims, 5 Drawing Sheets

LAMINA CLIPPING DEVICE AND METHOD

BACKGROUND OF THE INVENTION

1. Field Of The Invention

This invention as demonstrated herein relates to machinery for the woodworking and furniture manufacturing industries, and in particular to machinery used in producing laminated structures or materials.

2. Of The Prior Art Description And Objectives Of The Invention

It has become increasing popular in recent years to construct office and household furnishings with various veneers and laminate materials in order to save money over solid wood or metal products and to provide durable, attractive stylized designs. Desk tops, table tops and shelving materials are but a few of the many components manufactured today which employ inexpensive substrates which may be formed from pressed chipboard or other low priced compositions which are overlaid with a thin lamina of a synthetic material such as a polymeric veneer or natural product such as a wood veneer. Thus, synthetic laminas are often bonded by hot melt adhesives or quick setting glues and the so-formed-laminates are thereafter carefully trimmed to have a look of natural wood. In forming these laminates, the manufacturer has to be extremely careful to trim the edges so as to preserve the integrity of the appearance. Various machinery is now on the market for trimming square or flat edges of laminates having square corners, however for edges that are curved or have complex profiles, these generally require the outer surface lamina which is attached to be carefully trimmed by hand. When manually trimming table tops or other flat structures which have corners with complex edge profiles much time and effort has to be expended by skilled personnel. Since it is desirable to utilize as little manual labor as possible due to the expense and time required, complex profile lamina clipping apparatus would therefore be in great demand for use with automatic edging (laminating) machinery.

With the disadvantages and difficulties associated with lamina edge clipping, it is therefore one objective of the present invention to provide a mechanical device for clipping the excess lamina at the corner of a substrate having a complex edge profile.

It is yet another objective of the present invention to provide a method of clipping excess edge lamina from a substrate which is reliable, fast and accurate.

It is still another objective of the present invention to provide a device for clipping or trimming a lamina positioned on the edge of a substrate, regardless of the profile of the edge.

It is also an objective of the invention to provide a lamina clipping device which includes a first stationary laminate complementary blade and a second movable laminate complementary blade which engage to enclose a corner of the laminate while clipping excess edge lamina therefrom.

Various other objectives and advantages of present invention become apparent to those skilled in the art as a more detailed description of the invention is presented below.

SUMMARY OF THE INVENTION

The invention provides apparatus and a method for clipping excess lamina from the edges of substrates regardless of the complexity of the edge profile. The device includes a pair of complementary profile blades and one of the blade is movable relative to the other. A means is provided to drive the movable blade to the stationary blade for clipping the lamina and the pair of blades can be removed and replaced with blades which are complementary to other laminate edge profiles.

The preferred method of the invention comprises clipping a substrate having one edge with excess lamina by positioning a corner of the substrate with the excess lamina between first and second complementary blades, moving the first blade towards the second into engagement with the lamina and thereafter clipping the lamina as the blades fully engage. Thereafter the movable blade is retracted and the trimmed laminate removed.

DESCRIPTION OF THE PREFERRED EMBODIMENTS

Figure 1:
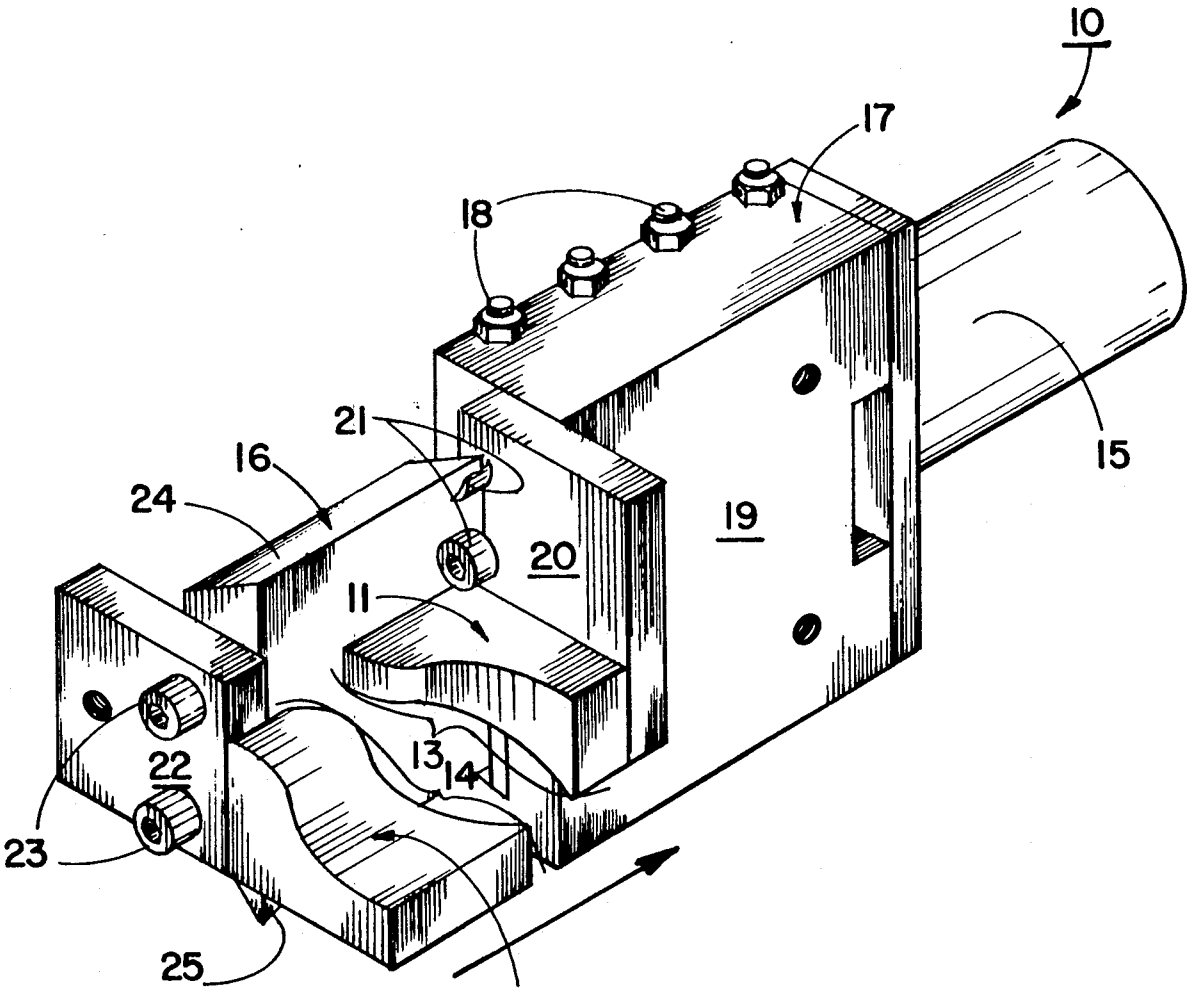
FIG. 1 shows a bottom front left side perspective view of the lamina clipping device of the invention.

The preferred form of the clipping device of the invention is shown in FIG. 1 and includes a base to which is attached a pair of laminate profile complementary blades. The first blade is affixed in rigid form to the base and the other blade is slidably positioned thereto. The slidable blade is driven by an air cylinder which is also attached to the base and said air cylinder will direct the movable blade to the fixed blade whereby a substrate corner with an edge having excess lamina can be placed therebetween and trimmed or clipped with the pair of complementary blades. The clipping device can be mounted on or in conjunction with an automatic edge binding machine or otherwise as desired by the user.

The preferred method of the invention comprises positioning a corner of a laminated substrate having an edge with excess lamina extending therefrom between a first laminate profile complementary blade and a second laminate profile complementary blade, directing the first blade towards the second to engage the excess lamina between the blades and thereafter cutting the excess lamina as the blades enclose the corner of the substrate. Finally, the first blade is withdrawn from the second blade and the trimmed laminate can be removed for other processing or manufacturing steps or uses.

DETAILED DESCRIPTION OF THE DRAWINGS AND OPERATION OF THE INVENTION

For a more detailed description of the invention and its method of operation, FIG. 1 illustrates in perspective fashion lamina clipping device 10 in independent form i.e., removed from conventional automated laminating machinery (not shown). Stationary blade 11 and movable blade 12 are shown thereon having cutting edges 13 and 14 respectively. As understood, cutting blades 11 and 12 are in the form of removable dies and are changeable for other contoured, three dimensional blades or dies and are shaped to fit completely against the profile (hence, complementary) of the contoured edge of a particular laminate upon which the blades are to be used.

Device 10 includes pneumatic cylinder 15 which provides a means to drive slide 16 to which blade 12 is attached. Cylinder 15 may be operated by compressed air, hydraulic fluid, electric power or otherwise as convenient and desirable with appropriate controls or switches (not shown). Base 17 of clipping device 10 includes a series of threaded studs 18 which adjust the tension of slide 16 in base 17, to insure a smooth even motion of slide 16. In FIG. 1 lamina clipping device 10 is turned upwardly to expose bottom 19 but in conventional operation bottom 19 of base 17 would be positioned downwardly. Stationary blade 11 is attached by screws or otherwise (not shown) to plate 20 and allen studs 21 are used to secure mounting plate 20 to base 17. Movable blade 12 is attached by screws or otherwise (not shown) to plate 22 which is held by allen studs 23 to slide 16. Slide 16 comprises a "dovetail" slide with a chamfered top edge 24 and a chamfered bottom edge 25. Base 17 includes a groove on the top side (not shown) which is machined to receive dovetail slide 16.

Figure 2:
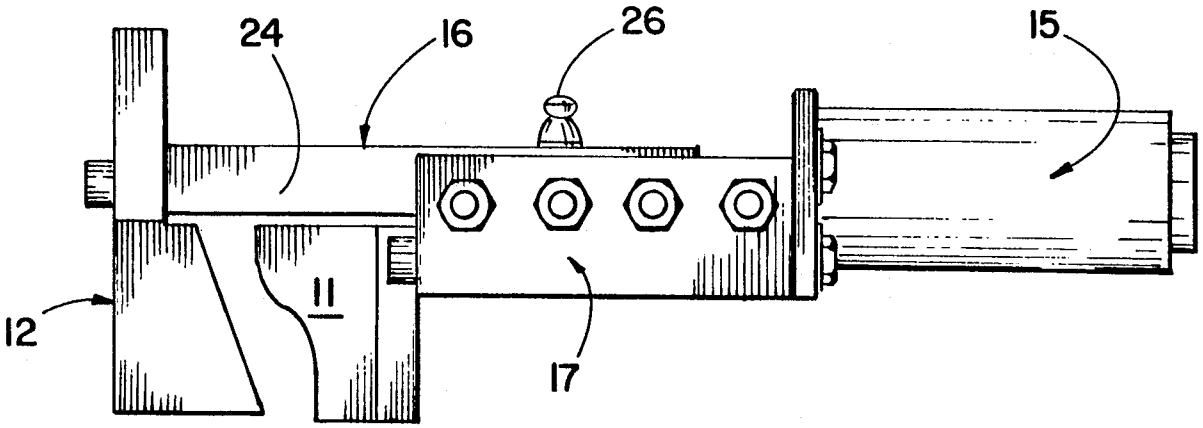
FIG. 2 demonstrates the top view of the device as shown in FIG. 1.

Grease fitting 26 is attached to the top of base 17 and is used to lubricate slide 16 as shown in FIG. 2. As understood, cylinder 15 is attached to a power source such as compressed air, hydraulic fluid pump or electricity as required for power. Also, slide 16 is joined to the distal end of the piston rod (not shown) of pneumatic cylinder 15 as would be understood to drive slide 16 by the movement thereof.

Figure 3:
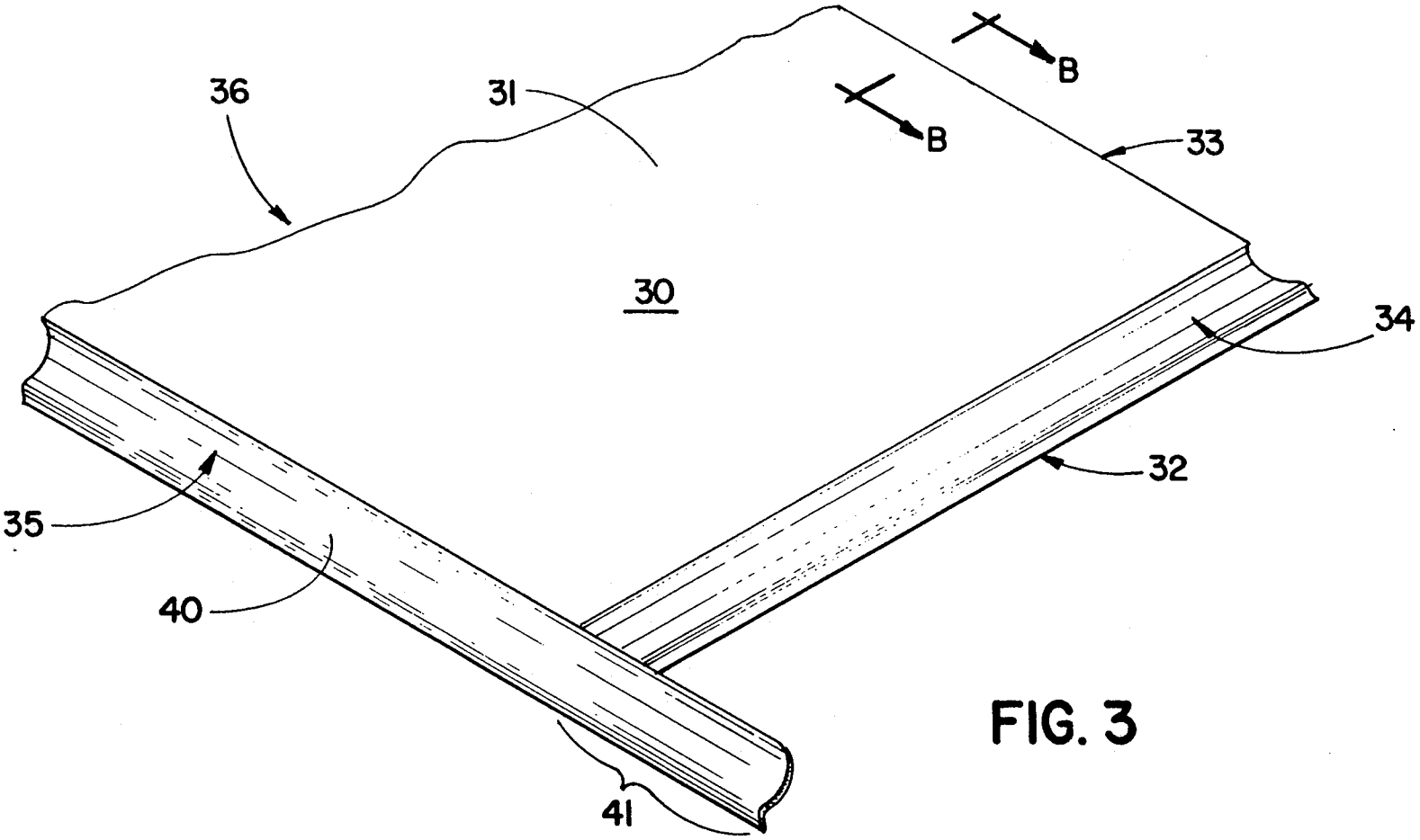
FIG. 3 illustrates a typical substrate which can be clipped with the device as shown in FIG. 1.

In FIG. 3, substrate 30 is shown which may be formed from an inexpensive compressed particle board. Substrate 30 has top surface 31, a bottom surface 32 and side edges 33, 34, 35 and 36 (36 is not shown in FIG. 3). A cross-sectional profile of the edges of substrate 30 are shown in FIG. 5B as along lines B—B (FIG. 3). As would be further understood, all four side edges of substrate 30 have the same complex profile as shown with 33 in FIG. 5B, thus making the trimming of a thin veneer or lamina 40 difficult during the final operational steps. As further shown in FIG. 3, lamina 40 may be formed from a synthetic polymeric substance such as vinyl (polyvinyl chloride) or formed from natural wood. In any event, lamina 40 is adhesively affixed to substate 30 as shown and has an excess extended portion 41 which must be removed.

Figure 4:
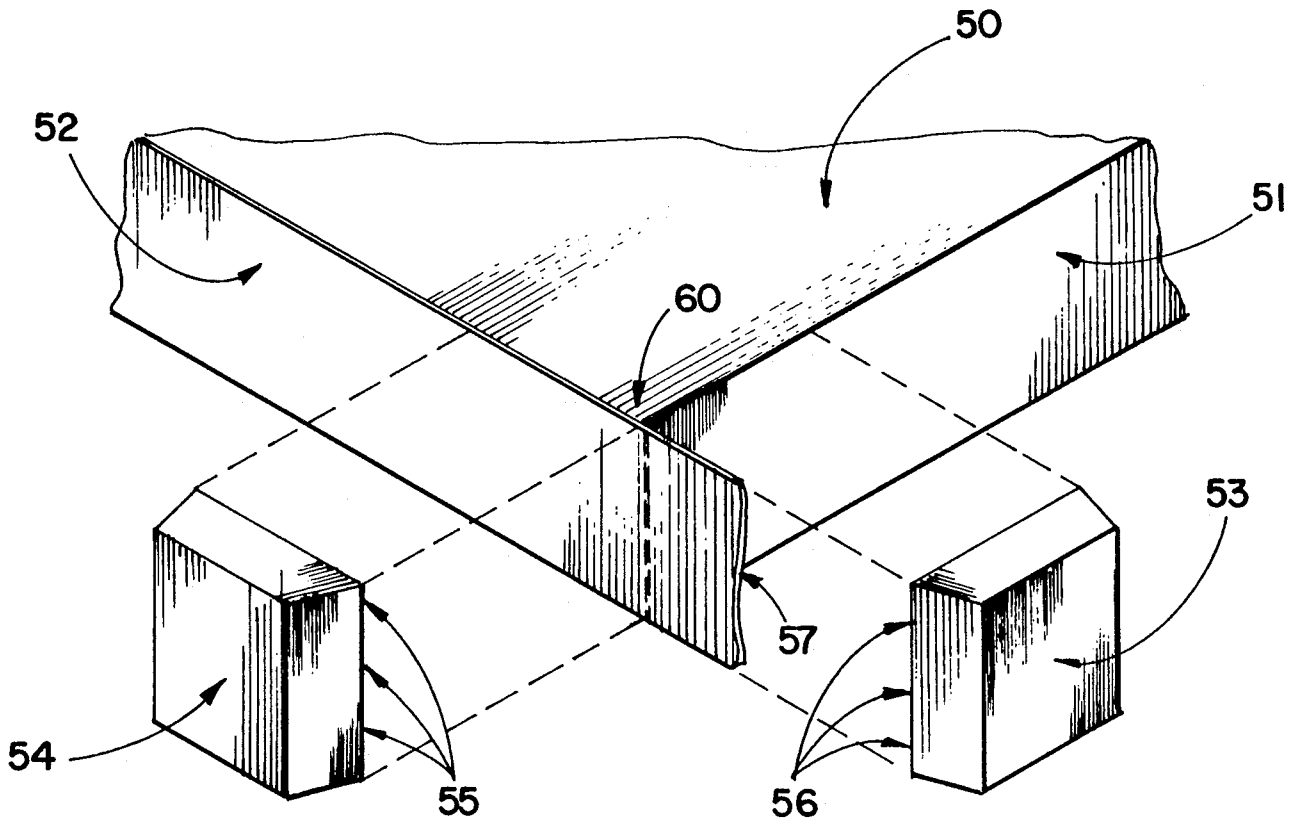
FIG. 4 depicts the complementary blades as may be used on a typical simple edge laminate prior to edge lamina clipping.

In FIG. 4 substrate 50 is shown with simple, flat edges 51, 52 for demonstrative purposes. Blades 53 and 54 enclose corner 60 during clipping and as they come together blade edges 55 and 56 shear excess lamina portion 57 of substrate 50. The profiles of edges 51 and 52 of substrate 50 are shown as simple, flat edges and are not complex profiles which were earlier mentioned and simple edges are used merely to demonstrate the action of blades 53 and 54.

Figure 5A:
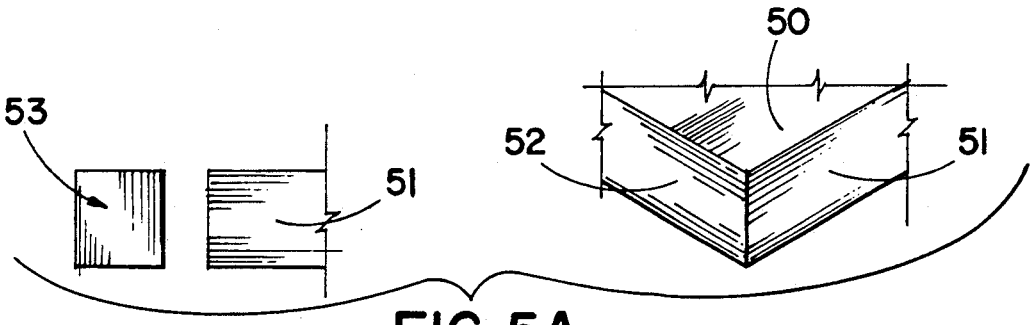
FIG. 5 pictures various substrate contours and complementary blades to be used therewith.
Figure 5B:
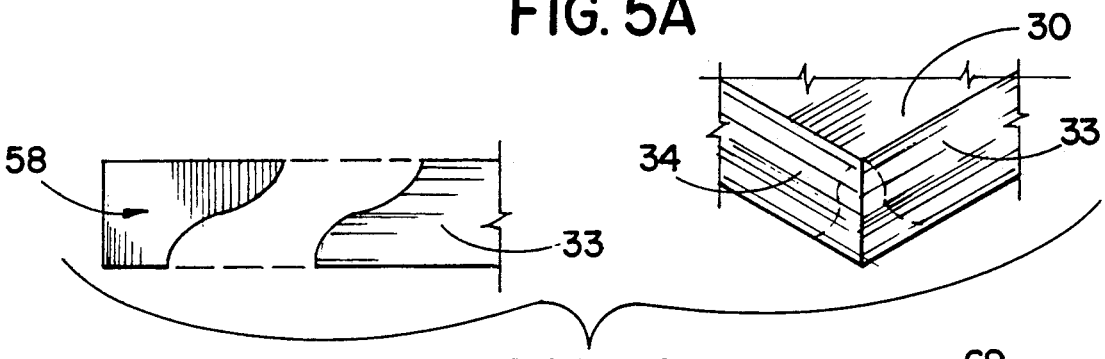
Figure 5C:
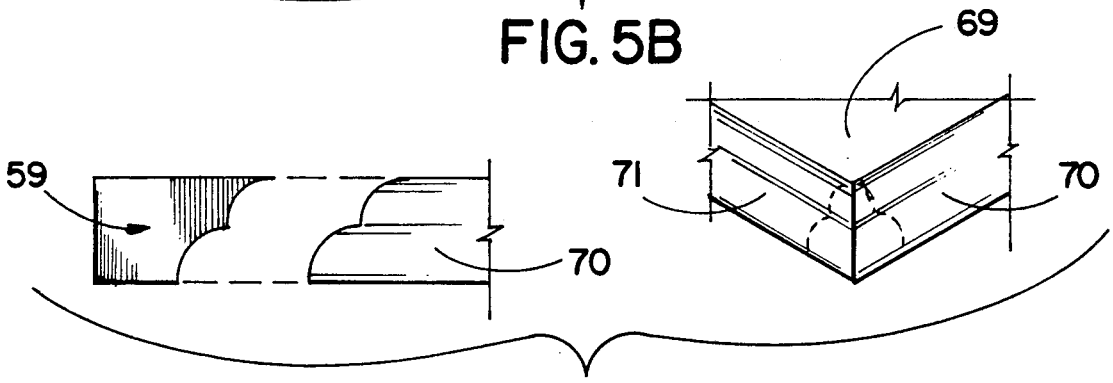

As would be further understood from FIG. 5, three different corners of substrates are shown with substrates 50, 30 and 69 having profile surfaces 33, 51 and 70 respectively. As seen in FIG. 5C, blade 59, which may be for example the movable blade, is configured to complement the complex profile edge 70. Blade 59 could be substituted for blade 12 of FIG. 1 and a matching, complementary blade would be substituted for stationary blade 11 whereby the complementary pair of blades would then operate to enclose the corner of substrate 69 as shown in FIG. 5C and clip excess lamina thereon upon actuation.

Figures 6A, 6B, 6C:
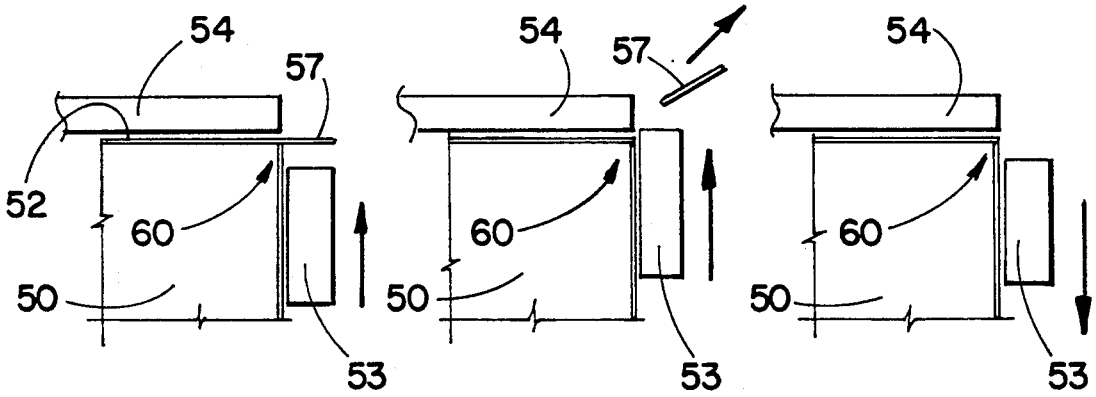
FIG. 6 illustrates top views A, B and C of a pair of cutting blades as they approach and clip a simple, flat edged laminate.

FIG. 6 shows a top schematic view of the method of operation of blades 53 and 54 whereby excess lamina portion 57 is clipped therefrom. In FIG. 6A, corner 60 of substrate 50 is positioned against blade 54 which blade 54 is the stationary blade, comparable to blade 11 in FIG. 1. Excess lamina or veneer portion 57 is shown extending beyond edge 52. As blade 53 is actuated, it moves in perpendicular fashion towards blade 54 where it contacts lamina portion 57 as illustrated in FIG. 6B and as corner 60 is enclosed, blades 53 and 54 clip excess portion 57 therefrom. Thereafter, blade 53 retracts and laminated substrate 50 is removed from blades 53 and 54, being neatly and efficiently clipped. Further laminating, edge attaching or the like is then carried out.

The illustrations and examples provided herein are for explanatory purposes and are not intended to limit the scope of the appended claims.

I claim:

1. A device for clipping excess lamina extending beyond a corner formed from the intersection of two edges of a laminated substrate, the lamina having a front and a back surface, comprising: a base, a pair of substantially perpendicularly positioned corner engaging blades attached to said base, said blades having cutting edges therealong, both of said cutting edges contoured to the front lamina surface, one of said blades movable relative to the other blade, said other blade being rigidly fixed to said base, whereby both cutting edges contact the lamina entirely along the lengths simultaneously so said excess lamina is efficiently clipped at the corner of the substrate by the movement of said movable blade toward the fixed blade.

2. A device as claimed in claim 1 wherein said movable blade is contoured to the from lamina surface.

3. A lamina clipping device for engaging the corner of a laminated substrate and clipping excess lamina extending beyond said corner along one of the intersecting edges of said sbustrate, the lamina having a complex profile with a front and a back surface comprising: a base, a first blade, said first blade comprising a cutting edge, means to drive said first blade, said drive means connected to said base, said first blade connected to said drive means, a second blade, said second blade comprising a cutting edge, said second blade rigidly joined to said base, both of said cutting edges contoured to the from lamina surface, said first blade edge substantially perpendicularly positioned to said second blade edge, said first and said second blade edges contacting said lamina entirely along their lengths simultaneously whereby said drive means will direct said first blade towards said second blade to clip excess lamina extending along said one intersecting edge of said substrate.

4. A device as claimed in claim 3 wherein said blade drive means comprises a pneumatic cylinder.

5. A device as claimed in claim 4 wherein said pneumatic cylinder comprises an air cylinder.

6. A device as claimed in claim 3 wherein said first blade comprises a laminate profile complementary blade.

7. A device as claimed in claim 3 wherein said second blade comprises a laminate profiled complementary blade.

8. A device as claimed in claim 3 and including a slide member, said slide member movably engageable with said base.

9. A device as claimed in claim 8 wherein said first blade is affixed to said slide member.

10. A device as claimed in claim 8 wherein said slide member is attached to said drive means.

11. A device as claimed in claim 8 and including a means to adjust the tension on said slide member as it engages said base, said tension adjusting means attached to said base.

12. A device as claimed in claim 3 and including means to actuate said drive means, said actuation means joined to said drive means.

13. A device as claimed in claim 12 wherein said actuation means comprises a switch.

14. A method for clipping excess lamina which extends beyond the corner formed by two intersecting edges of a laminated substrate, the lamina having a complex profile with a back surface and a front surface, comprising the steps of:

(a) positioning the corner of the substrate with excess edge lamina between a first movable blade having a cutting edge contoured to the front surface of said lamina and a second rigidly fixed blade having a cutting edge contoured to the front surface of said lamina, (b) moving the first blade towards said second complementary blade, (c) engaging the excess edge lamina between the blade edges along the entire length of each of said blade edges simultaneously, and (d) cutting the excess lamina as the blade edges enclose the substrate corner.

15. The method of claim 14 wherein the step of moving the first blade toward the second blade comprises pneumatically moving the first blade toward said second blade.

16. The method of claim 14 wherein the step of moving the first blade towards the second blade comprises moving the first blade in a direction whereby said second blade and said first blade are disposed substantially perpendicular during the cutting of the lamina.

17. The method of claim 14 wherein the step of moving the first blade towards said second blade includes actuating a drive means joined to said first blade.

* * * * *